US007922270B2

(12) United States Patent
Weber

(10) Patent No.: US 7,922,270 B2
(45) Date of Patent: Apr. 12, 2011

(54) PULL-IN AND DAMPING DEVICE FOR A DISPLACEABLE ELEMENT

(75) Inventor: Bernhard Weber, Lucerne (CH)

(73) Assignee: Peka-Metall AG, Mosen (CH)

( * ) Notice: Subject to any disclaimer, the term of this patent is extended or adjusted under 35 U.S.C. 154(b) by 509 days.

(21) Appl. No.: 12/104,906

(22) Filed: Apr. 17, 2008

(65) Prior Publication Data

US 2008/0265732 A1 Oct. 30, 2008

(30) Foreign Application Priority Data

Apr. 30, 2007 (EP) ..... 07107249

(51) Int. Cl.
*A47B 88/04* (2006.01)

(52) U.S. Cl. ..... 312/333; 312/319.1

(58) Field of Classification Search ..... 312/319.1, 312/330.1, 333, 334.1, 334.7, 334.44; 384/21, 384/22

See application file for complete search history.

(56) References Cited

U.S. PATENT DOCUMENTS

| | | | | |
|---|---|---|---|---|
| 4,494,806 | A * | 1/1985 | Williams et al. | 312/333 |
| 4,586,761 | A * | 5/1986 | Shimbara | 312/319.1 |
| 7,537,296 | B2 * | 5/2009 | Leon et al. | 312/333 |
| 2004/0104649 | A1 * | 6/2004 | Muller et al. | 312/333 |

FOREIGN PATENT DOCUMENTS

JP 2007203079 * 8/2007

* cited by examiner

*Primary Examiner* — James O Hansen
(74) *Attorney, Agent, or Firm* — Pearne & Gordon LLP

(57) ABSTRACT

A pull-in and damping device for a displaceable element has a displacement part (2), movable transversely to the displacement direction of the element, with a cam (14), which displacement part (2) is pullable, via spring means (13), from a moved-out position into a moved-in position, the cam (14) co-operating with curved pathways (6, 7), which have a minimum (24) and a maximum (25). The displacement part (2) is held in a clamped way via a clamping device (4) when, during displacement of the displaceable element from the end position into a moved-out position, the cam (14) of the displacement part (2) reaches the maximum (25) of the curved pathways (6, 7), and which clamping holding of the displacement part (2) is released when, during the pushing back of the displaceable element, the cam (14) of the displacement part (2) reaches the maximum (25) of the curved pathway (6, 7).

9 Claims, 8 Drawing Sheets

PULL-IN AND DAMPING DEVICE FOR A DISPLACEABLE ELEMENT

The present invention relates to a pull-in and damping device for a displaceable element, which element is displaceable at least on one side along guides, with respect to a stationary part, from an end position, into which the element is able to be pulled in by the pull-in and damping device, and which pull-in and damping device has a displacement part, movable transversely to the displacement direction of the element, along guides, with a cam, which guides are mountable on the displaceable element, or respectively on the stationary part, and which displacement part is pullable, via spring means, from a moved-out position into a moved-in position, and the cam co-operates with curved pathways provided on a curved element, which curved element is attachable to the stationary part, or respectively to the displaceable element, which curved pathways have a minimum for the moved-in position and a maximum for the moved-out position of the displacement part.

Such pull-in and damping devices can be used everywhere a displaceable element is supposed to be opened, with respect to a stationary part, from a closed position, for example, whereby, during moving back into the closed position, this element is brought into the closed position independently by the pull-in and damping device, the movement being damped. Displaceable elements of this kind can be sliding doors, window sashes of displaceable windows, sliding doors of closets, pull-out parts of cupboards, drawers of furniture elements, etc., in which a damped, independent pulling into the end position is desired.

Such a device is known, for example, from the European patent publication EP 1 815 768. This device is used for damped pulling in of a drawer, able to be pulled out on both sides, of a furniture element. This device has a locking mechanism with which the displacement part is locked in the pulled-out position and before leaving the curve region. Upon pushing in of the drawer, and when the displacement part arrives in the region of the curve, this locking is released; the displacement part is pulled back by means of spring force, and the drawer thus arrives in the closed position.

With this device, the assembly of the guiding part and of the cam must be carried out very precisely, drawer-side and furniture-element-side. The locking element must likewise be exactly aligned, so that the locking of the displacement part takes place in the highest position of the curve. If the alignment is not carried out precisely, or if there is a lot of play between drawer and furniture element, the locking must take place before the highest point of the curve is reached in order to be able to achieve a secure locking. Upon pushing back of the drawer, this has the consequence that the displacement part abuts the curved face, and has to pass over the highest point of this curved face. To do this, the resiliently pretensioned displacement part has to be correspondingly moved, which results in an unaesthetic course of movement during the pushing in of the drawer.

The object of the present invention thus consists in designing a pull-in and damping device in such a way that a blocking of the displacement part takes place exactly when passing over the highest point of the curved face, regardless of how precisely the cam and the displacement part are mounted on the respective elements, so that an optimal course of movement is achievable.

This object is achieved according to the invention in that a clamping device is provided on the guides by means of which clamping device the displacement part is held in a clamped way, when, during displacement of the displaceable element from the end position into a moved-out position, the cam of the displacement part reaches the maximum of the curved pathways, and which clamping holding of the displacement part is releasable when, during the pushing back of the displaceable element, the cam of the displacement part reaches the maximum of the curved pathways.

Achieved with this design of the invention is that the displacement part is held in a clamped way in exactly the right position, and to be precise, during the passing over of the maximum of the curved pathways, a corresponding holding of the displacement part in the maximum also being achieved when the curved element, containing the curved pathways, and/or the displacement part are not mounted so very precisely on the respective elements.

Preferably the clamping device comprises a lever, which is pivotably held and which is provided with two stop faces, which are disposed on both sides of a slide rail of the displacement part, and in pivoted state come to abut the slide rail. A simple clamping of the displacement part is thereby achieved.

Preferably, the pivot point, about which the lever is substantially pivotable, is formed by a support toe, on which the lever rests, and the lever is pushable via a spring element into the pivoted position. Thereby achieved is that, during clamping, the lever can shift such that the two stop faces come to abut on the sliding rail on both sides in an optimal way, whereby an optimal clamping is achieved.

Preferably, the lever is provided with an extension projecting beyond the support toe, on the end of which extension a guide cam is provided, which guide cam co-operates with a further curved pathway provided on the curved element. The clamping of the displacement part and the release of the clamping can thereby be controlled optimally and exactly.

Another advantageous embodiment of the invention consists in that the spring means are designed as tension spring, which is provided between the displacement part and the guides, and a damping element for damping the pull-in movement of the displacement part is provided between displacement part and guides. An optimal, independent and damped pull-in movement is thereby achieved for the displaceable element.

Another advantageous embodiment of the invention consists in that the curved element has between minimum and maximum a first curved pathway, along which the cam of the displacement part follows during the moving out of the displaceable element, and a second curved pathway, along which the cam follows during the moving in of the displaceable element, and switch tongues are provided between the first curved pathway and the second curved pathway. The first curved pathway can thus have a different inclination from the second curved pathway, whereby, with lesser inclination of the first curved pathway, for example, a lesser force has to be applied for tensioning the displacement part during the pulling out of the displaceable element, while an optimal course of movement can be achieved during the pulling in along the second curved pathway.

A further advantageous embodiment of the invention consists in that the curved element is designed in such a way that substantially symmetrically disposed first and second curved pathways are provided on both sides of the minimum. Thereby achieved is that the displaceable element can be pulled out on both sides, and that an independent, damped pulling into the desired end position of the displaceable element is achieved from both sides.

Preferably, disposed bordering on the maximum of the first curved pathway and of the second curved pathway is a third curved pathway, which runs descending away from the maximum. Thereby achieved can be that, with the first pushing in of a newly mounted pull-in and damping device, the displacement part is brought into the correct position, or incorrect functioning of the clamping device can be corrected.

An embodiment of the invention will be explained more closely in the following, by way of example, with reference to the attached drawing.

DETAILED DESCRIPTION OF THE INVENTION

Figure 1:
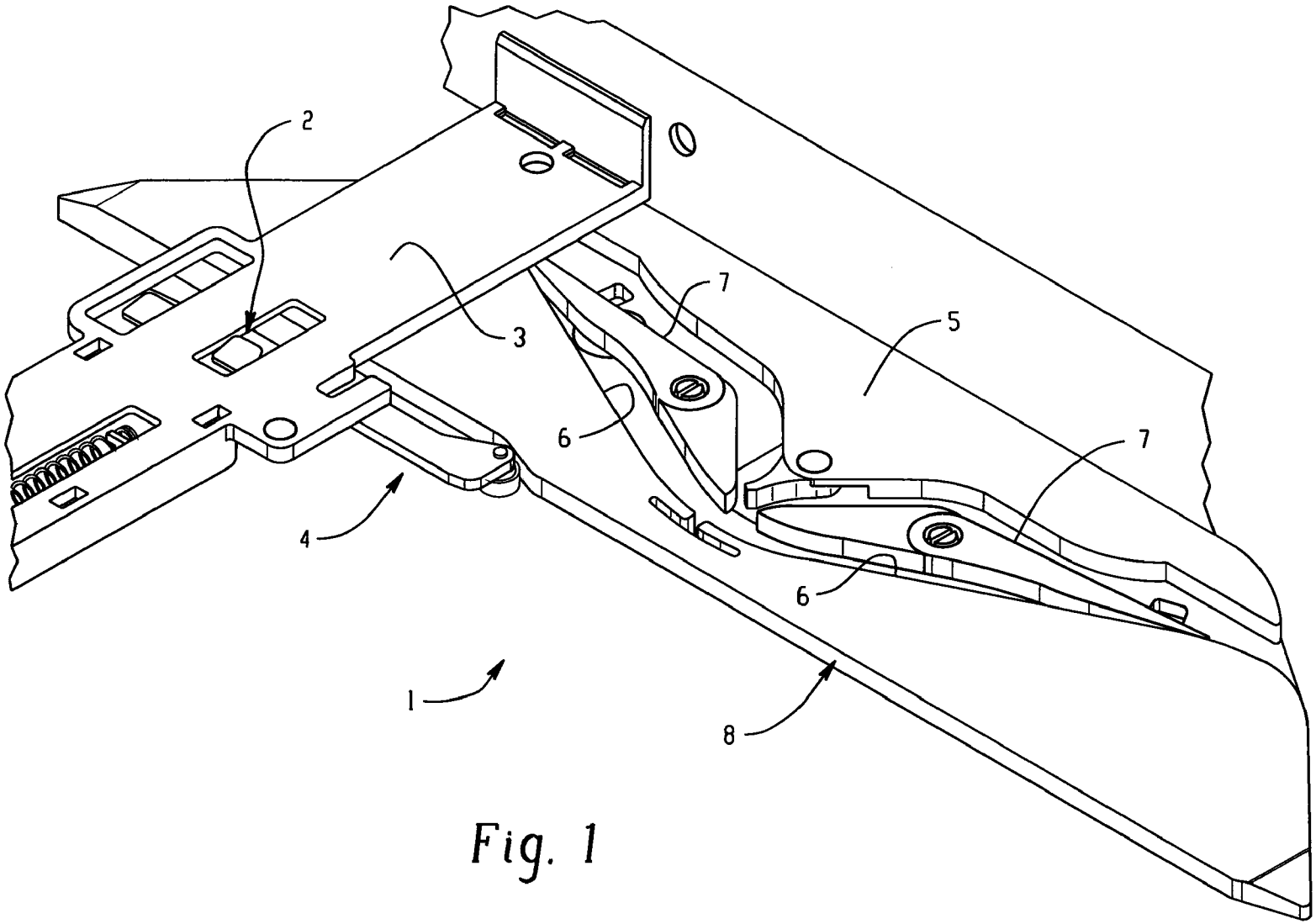
FIG. 1 shows in a spatial representation a view of the pull-in and damping device according to the invention.

Shown in FIG. 1 is a pull-in and damping device 1 according to the invention comprising a displacement part 2 which is accommodated in a housing part 3 that acts as guides for the displacement part 2. Attached to the displacement part 2 is a clamping device 4; the mode of operation of this clamping device 4 and of the displacement parts 2 will still be described in detail later on.

Also visible from FIG. 1 is a curved element 5 which comprises first curved pathway 6, second curved pathways 7 and a further curved pathway 8, which first curved pathway 6 and second curved pathway 7 serve the controlled displacement of the displacement part, while the further curved pathway 8 controls the clamping device 4, as will still be described later on in detail.

Figure 2:
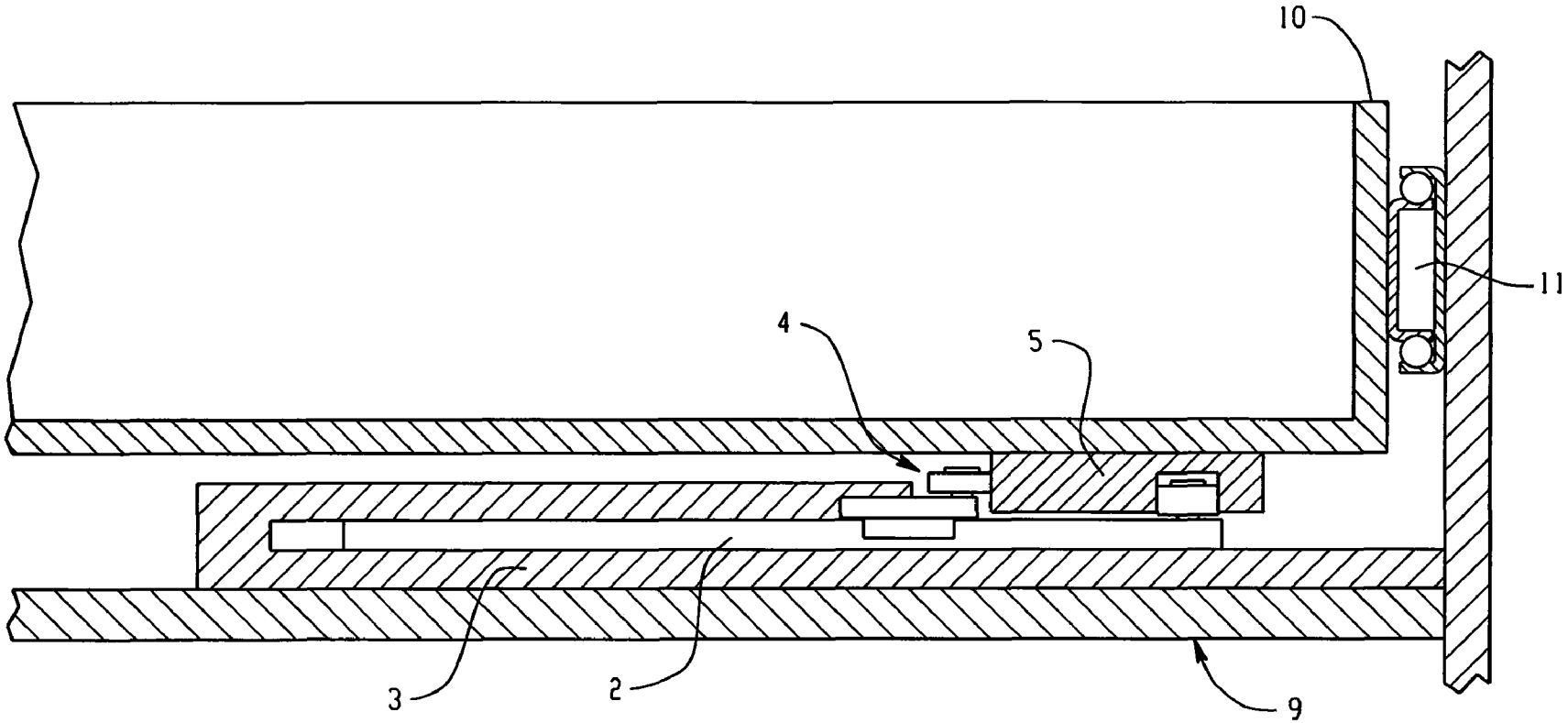
FIG. 2 shows in a diagrammatical, sectional representation the configuration of the pull-in and damping device according to the invention in the installed state in a drawer, which drawer is borne in a furniture element in a way able to be pulled in and pulled out.

FIG. 2 shows in section and in a diagrammatic representation the configuration of the pull-in and damping device in a furniture element 9 with drawer 10 able to be pulled in and pulled out. In the embodiment shown here, the curved element 5 is fixed to the drawer 10, able to be pulled out with respect to the furniture element 9 via linear guides 11. The housing part 3 with the therein displaceably guided displacement part 2 is fixed to the furniture element 9. The curved element 5 is thus moved with respect to the displacement part 2 by the pulling out of the drawer 10, the functions described later on being carried out. Of course it would also be conceivable to attach the curved element 5 to the furniture element 9, while the housing part 3, with the displacement part 2 displaceably held therein, could be attached to the drawer 10, able to be pulled out.

This pull-in and damping device 1 can be used for any type of displaceable elements that are able to be brought from an end position, along guides, into a pulled-out position, and which, during pushing back toward the end position, are pulled into the end position by the pull-in and damping device in an independent and damped way, shortly before reaching the end position. Besides displaceable drawers used in furniture elements, this could also be door wings of sliding doors, window sashes of displaceable windows, sliding doors of closets or cupboards, pull-out parts of cupboards, etc.

Figure 3:
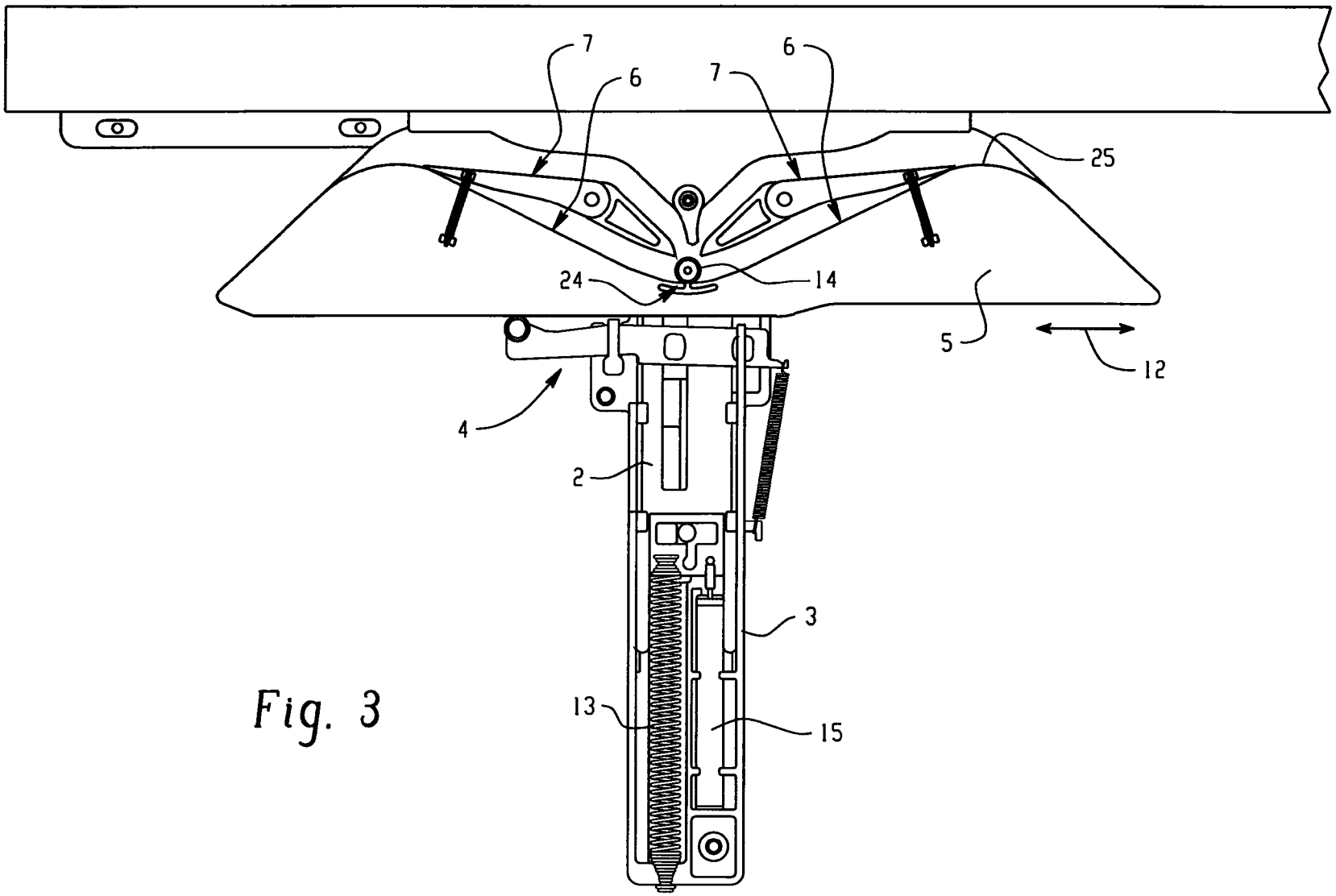
FIG. 3 shows a representation of the curved element and the displacement part co-operating therewith, the displacement part being situated in the moved-in position.

Visible from FIG. 3 is the structure of the displacement part 2, which is displaceably borne in the housing part 3 transversely to the pull-out direction (shown by the double arrow 12) of the displaceable element. This displacement part 2 is pulled into a moved-in position, as is shown here in FIG. 3, via a tension spring 13 which is disposed between displacement part 2 and housing part 3. In this moved-in position, a cam 14, provided on the displacement part 2, is located in the minimum 24 of the first curved pathway 6 of the curved element 5. This moved-in position of the displacement part 2 represents at the same time the end position of the displaceable element with respect to the stationary part. Disposed parallel to the tension spring 13 is a damping element 15, which causes the displacement movement of the displacement part 2, brought about through the tension spring 13, to take place in a damped way.

Visible on the housing part 3 is the clamping device 4 for the clamping holding of the displacement part 2, which clamping device, in the position of the displacement part 2 shown here, is located in the released position.

Figure 4:
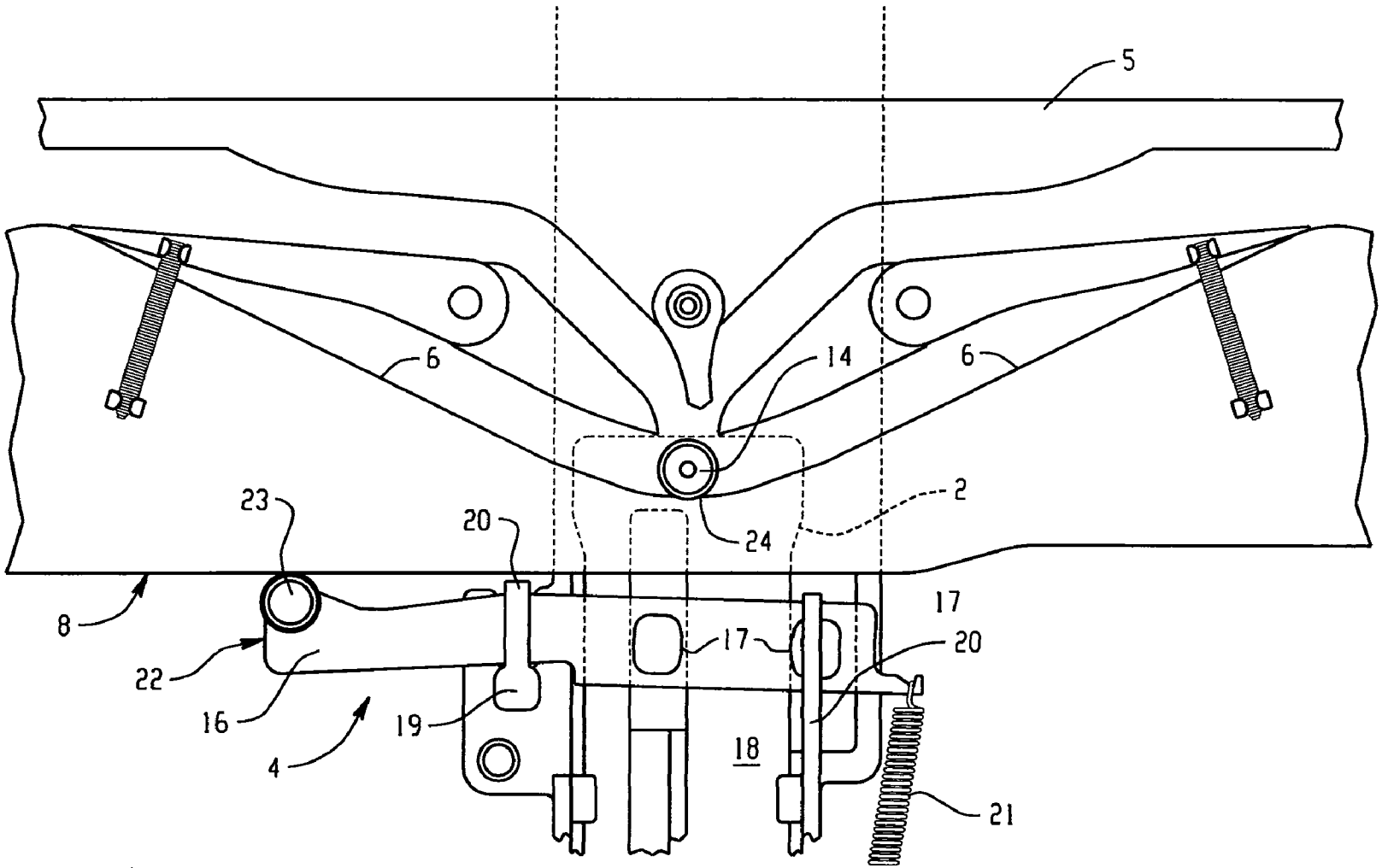
FIG. 4 shows an enlarged representation of a section of the curved element and of the displacement part according to FIG. 3.

As is visible from FIG. 4 in particular, this clamping device 4 consists of a lever 16, which is pivotably held, and which is provided with two stop faces 17, which are disposed on both sides of a slide rail 18 provided on the displacement part 2. The pivot point, about which the lever 16 is pivotable, is formed by a support toe 19, which is attached to the housing part 3. On this support toe 19 rests the lever 16; a cradle movement is thus obtained upon pivoting of this lever 16 about this support toe 19. The lever 16 is held by guide plates 20, which are attached to the housing part 3.

The lever 16 is pretensioned via a spring element 21 in FIG. 4 about the support toe 19 in clockwise direction. The lever 16 is provided with an extension 22 projecting beyond the support toe 19, on the end region of which extension a guide cam 23 is provided. This guide cam 23 supports itself on the further curved pathway 8 that is provided on the curved element 5. In the moved-in position of the displacement part 2 shown in FIG. 4, the cam 14 attached to the displacement part is located in the minimum 24 of the first curved pathway 6. The lever 16 is located in a position in which the two stop faces 17 are not in contact with the sliding rail 18 of the displacement part 2; i.e. in this position of the lever 16, the displacement part 2 can be displaced in an unimpeded way.

Figure 5:
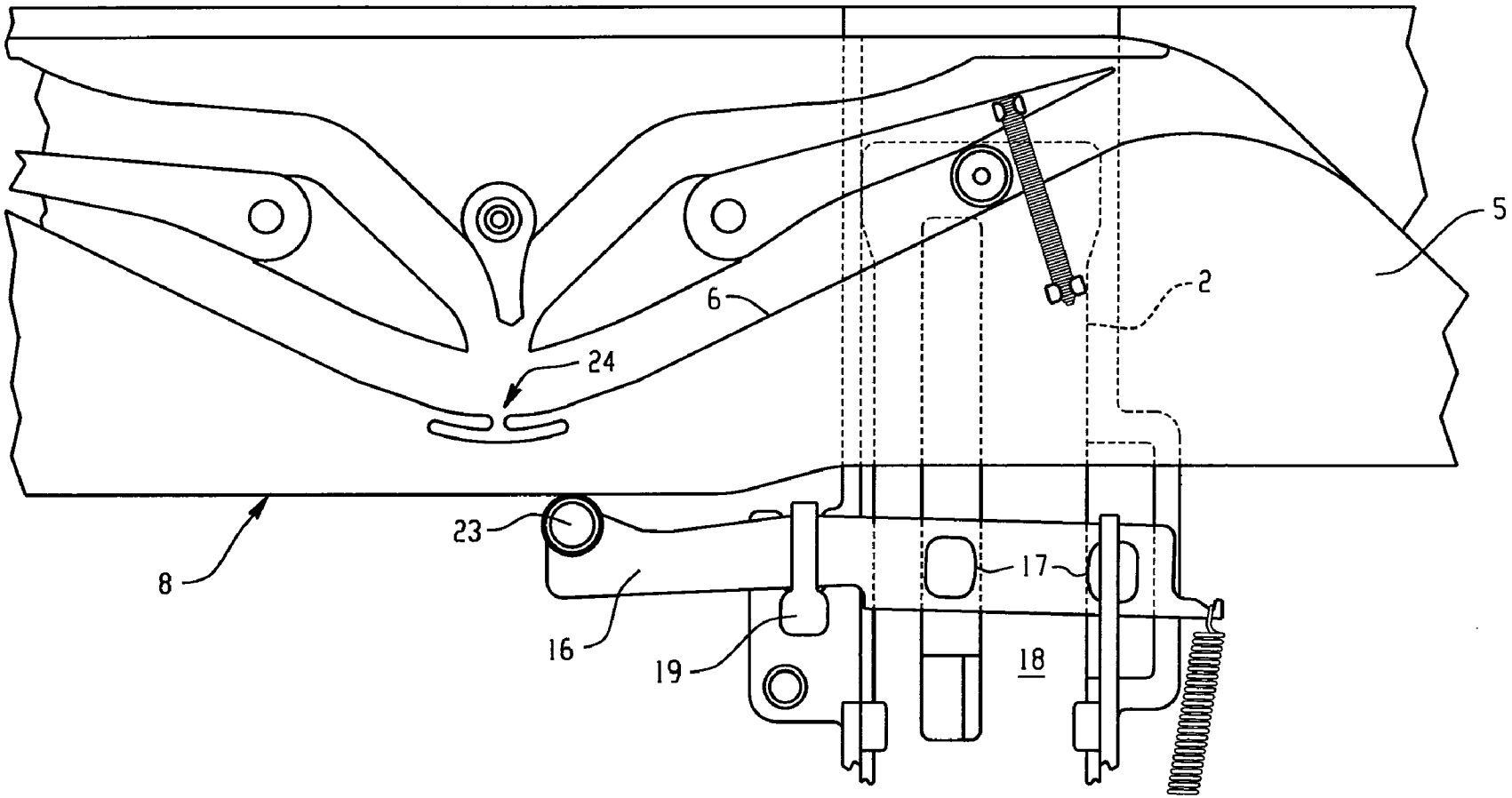
FIG. 5 shows a view of the curved element and the displacement part during the moving-out step.

Now when the displaceable element is pulled out of the end position, this means that the displacement part 2, displaceably held in the housing part 3, moves from the moved-in position shown in FIG. 4 toward a moved-out position, as this is shown in FIG. 5. During this displacement, the cam 14, attached to the displacement part 2, follows the first curved pathway 6, the tension spring 13 (FIG. 3) being tensioned. During this course of movement, the guide cam 23 of the lever 16 follows the further curved pathway 8. This further curved pathway 8 in this region is aligned parallel to the displacement direction of the displaceable element. The lever 16 remains in its starting position. The stop faces 17 are not in contact with the sliding rail 18. The displacement part 2, controlled by the cam 14, therefore continues to be freely displaceable.

Figure 6:
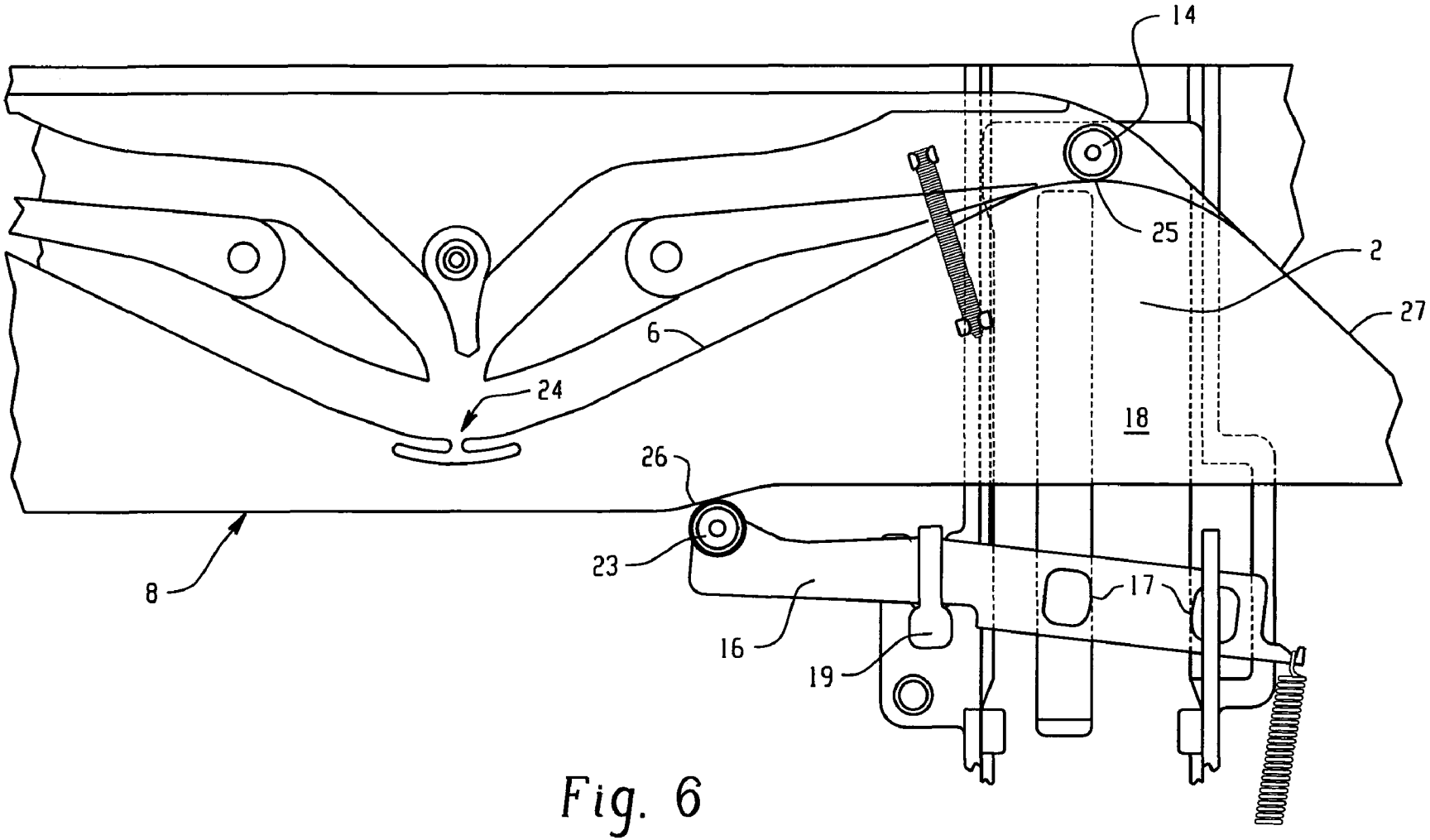
FIG. 6 shows a view of the curved element and of the displacement part when the displacement part is situated in the completely moved-out position.

With further pulling out of the displaceable element, the cam 14 of the displacement part 2 arrives at the maximum 25 of the first curved pathway 6, as this is shown in FIG. 6. When the cam 14, which is attached to the displacement part 2, reaches this maximum 25, the guide cam 23 of the lever 16 ends up in an inclined region 26 of the further curved pathway 8. Via the spring element 21, the lever 16 is pivoted in this region about the support toe 19 in clockwise direction. In so doing, the two stop faces 17 are pressed against the sliding rail 18, the sliding rail 18 is thereby held clamped between the two stop faces 17, whereby the displacement part 2 is blocked. The tension spring 13 (FIG. 3) is located in the tensioned state.

Figure 7:
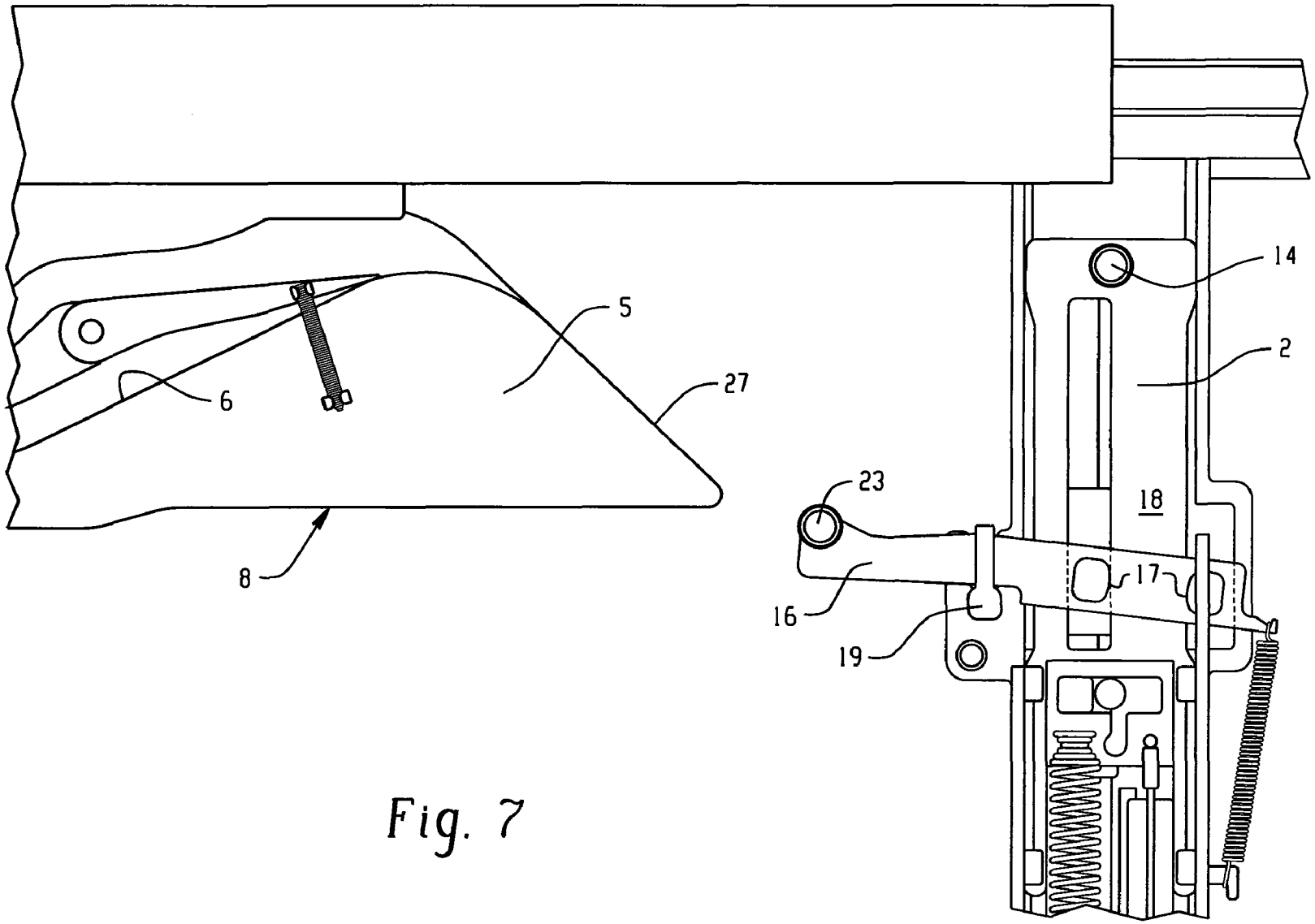
FIG. 7 shows a view of the curved element and of the displacement part in a position where the displacement part has completely left the curved element.

As can be seen from FIG. 7, with further displacement of the displaceable element away from the end position, as it is shown in FIG. 3, the displacement part 2 ends up outside the sphere of influence of the curved element 5. The displacement part 2 remains here in the moved-out position, clamped by the stop faces 17 of the pivoted lever 16, which stop faces 17 abut the sliding rail 18, and hold it in a clamped way by the corresponding wedging action.

In that the lever 16 rests on the support toe 19, it is positioned, through the possibility of a shifting of the lever 16 in relation to the support toe 19, with clamping holding of the sliding rail 18 of the displacement part 2, in such a way that the stop faces 17 clamp the sliding rail 18 optimally.

With the moving back of the displaceable element toward its end position, as this is shown in FIG. 3, the cam 14, in the region of the maximum 25, moves on the first curved pathway 6, corresponding to the representation in FIG. 6. At this moment, through the inclined region 26 of the further curved pathway 8, the lever 16 is pivoted back, about the support toe 19, against the force exerted by the spring element 21, the clamping of the two stop faces 17 on the sliding rail 18 is released, and the displacement part 2 is free again.

Figure 8:
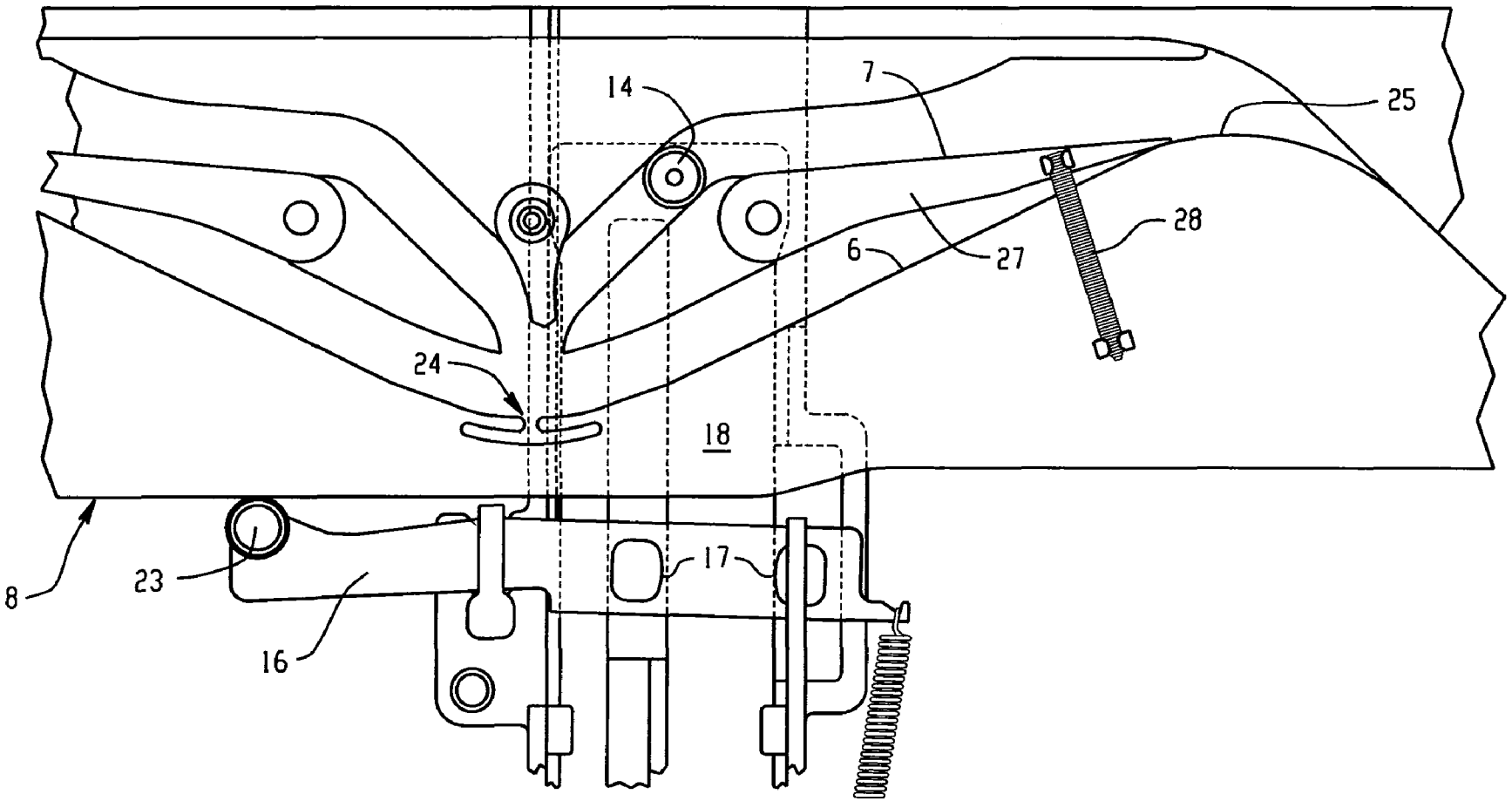
FIG. 8 shows a view of the curved element and of the displacement part during the pull-in step.

With further pushing in, the cam 14 ends up on the second curved pathway 7, which is formed by a switch tongue 27, which switch tongue 27 is brought into the position shown in FIG. 8, brought about through a further tension spring 28, after moving of the displacement part 2 out of the region of the curved element 5. This second curved pathway 7 descends less steeply in a first region from the maximum 25 toward the minimum 24, while, in a second region, the steepness increases. In this second, steeper region of the second curved pathway 7, the displaceable element is pulled via the displacement part 2, in co-operation with the second curved pathway 7, toward the minimum 24 of the curved pathway, this pull-in force being relatively great, whereby it is ensured that the displaceable element ends up in the pulled-in end position.

In the previously presented embodiment example, the curved element 5 is designed such that, from the minimum 24 outward, first curved pathways 6 and second curved pathways 7 are symmetrically disposed. This means that the displaceable element and thus the displacement part 2 can be pulled out on both sides of the curved element 5, and can be pulled back again independently into the end position from both sides. This is particularly advantageous with drawers able to be pulled out of furniture elements on both sides. This is also advantageous, however, with sliding door elements, these elements not being an edge element and these—therefore middle—elements being able to be displaced on both sides. Of course it is conceivable for the curved element 5 to be provided with just a first curved pathway 6 and a second curved pathway 7, so that a pulling out of the displaceable element is possible in one direction only, which is the case, for example, with drawers or pull-out elements able to be pulled out on one side or with laterally displaceable wings of sliding doors.

Following the first curved pathway 6, a third curved pathway 29 is provided after the maximum 25, which descends from the maximum 25, as can be seen in particular in FIG. 6 and FIG. 7. This third curved pathway 29 serves in particular the purpose that, with newly mounted pull-in and damping device, the displaceable element can nevertheless be pushed into the curved element 5 even when the displacement part 2 is not, or not completely, in the moved-out position. The displacement part 2 is then brought into the completely moved-out position through the third curved pathway 29, the application of force being relatively great since the clamping effect of the two stop faces 17 of the lever 16 must be overcome.

Achieved with this design of the pull-in and damping device according to the invention is that, during the moving of the displacement part 2 out of the first curved pathway 6, this displacement part is held in exactly the right position upon reaching the maximum of this curved pathway, regardless of how precisely the corresponding elements are mounted with respect to one another; during the pushing back and during the moving of the displacement part 2 into the maximum 25 of the first curved pathway 6, the correct position is thereby ensured. The course of movement is thus optimal.

What is claimed is:

1. A pull-in and damping device for a displaceable element, the displaceable element being displaceable at least on one side along guides, with respect to a stationary part, from an end position, into which the displaceable element is able to be pulled in by the pull-in and damping device, the pull-in and damping device including:

a displacement part that is movable transversely to a displacement direction of the displaceable element along the guides with a cam, the guides are mountable on either of the displaceable element or the stationary part, and the displacement part is pullable via spring means between a moved-out position and a moved-in position;

curved pathways provided on a curved element, the cam co-operates with the curved pathways, the curved element is attachable to either of the stationary part or the displaceable element, and the curved pathways have a minimum for the moved-in position and a maximum for the moved-out position; and a clamping device provided on the guides, the clamping device is configured to hold the displacement part in a clamped way, wherein during displacement of the displaceable element from the end position into a moved-out position, the cam of the displacement part reaches the maximum of the curved pathways, and the clamping holding of the displacement part is releasable when, during the pushing back of the displaceable element, the cam of the displacement part reaches the maximum of the curved pathways.

2. The pull-in and damping device according to claim 1, wherein the clamping device comprises a lever, the lever is pivotably held and is provided with two stop faces, and the two stop faces are disposed on both sides of a slide rail of the displacement part, and in pivoted state come to abut the slide rail.

3. The pull-in and damping device according to claim 2, further including a pivot point, the lever is substantially pivotable about the pivot point, the pivot point is formed by a support toe, and the lever rests on the support toe and is pushable via a spring element into the pivoted position.

4. The pull-in and damping device according to claim 3, wherein the lever is provided with an extension projecting beyond the support toe, and a guide cam is provided on an end region of the extension.

5. The pull-in and damping device according to claim 4, wherein the guide cam provided on the end region of the extension co-operates with a further curved pathway provided on the curved element.

6. The pull-in and damping device according to claim 1, wherein the spring means are designed as a tension spring, wherein the tension spring is provided between the displacement part and the guides, and a damping element for damping the pull-in movement of the displacement part is provided between displacement part and guides.

7. The pull-in and damping device according to claim 1, wherein the curved element has between the minimum and the maximum a first curved pathway, the cam of the displacement part follows the first curved pathway during the moving out of the displaceable element, and the curved element includes a second curved pathway, and the cam follows the second curved pathway during the moving in of the displaceable element, and switch tongues are provided between the first curved pathway and the second curved pathway.

8. The pull-in and damping device according to claim 1, wherein the curved element is designed in such a way that substantially symmetrically disposed first curved pathways and second curved pathways are provided on both sides of the minimum.

9. The pull-in and damping device according to claim 1, wherein a third curved pathway is disposed bordering on the maximum of the first curved pathway and of the second curved pathway, and the third curved pathway runs descending away from the maximum.

* * * * *